US005831473A

United States Patent [19]

Ishii

[11] Patent Number: 5,831,473

[45] Date of Patent: Nov. 3, 1998

[54] REFERENCE VOLTAGE GENERATING CIRCUIT CAPABLE OF SUPPRESSING SPURIOUS VOLTAGE

[75] Inventor: Noriko Ishii, Tokyo, Japan

[73] Assignee: NEC Corporation, Tokyo, Japan

[21] Appl. No.: 880,992

[22] Filed: Jun. 23, 1997

[30] Foreign Application Priority Data

Jun. 21, 1996 [JP] Japan ..... 8-181413

[51] Int. Cl.[6] ..... G05F 1/10

[52] U.S. Cl. ..... 327/530; 327/538; 327/544; 323/313

[58] Field of Search ..... 327/530, 538, 327/543, 544, 551; 323/313, 315

[56] References Cited

U.S. PATENT DOCUMENTS

| | | | |
|---|---|---|---|
| 4,492,858 | 1/1985 | Mizokami | 250/214 P |
| 5,373,226 | 12/1994 | Kimura | 323/313 |
| 5,512,855 | 4/1996 | Kimura | 327/538 |
| 5,615,151 | 3/1997 | Furuno et al. | 365/185.18 |
| 5,719,522 | 2/1998 | Saitou et al. | 327/540 |

*Primary Examiner*—Timothy P. Callahan
*Assistant Examiner*—Jung Ho Kim
*Attorney, Agent, or Firm*—Sughrue, Mion, Zinn, Macpeak & Seas, PLLC

[57] ABSTRACT

In a reference voltage generating circuit including a current mirror circuit having an input and an output, a bias current supply circuit for supplying a bias current to the input of the current mirror circuit, a switching element for turning ON and OFF the bias current supply circuit, and an output transistor for generating a reference voltage, a delay circuit formed by a capacitor is connected to the output of the cirrent mirror circuit.

5 Claims, 6 Drawing Sheets

REFERENCE VOLTAGE GENERATING CIRCUIT CAPABLE OF SUPPRESSING SPURIOUS VOLTAGE

BACKGROUND OF THE INVENTION

1. Field of the Invention

The present invention relates to a reference voltage generating circuit having a power saving function.

2. Description of the Related Art

Reference voltage generating circuits are used in integrated circuits. Particularly, in digital mobile apparatuses, in order to reduce the power dissipation, a power saving function is adopted in a reference voltage generating circuit.

In a prior art reference voltage generating circuit including a current mirror circuit having an input and an output, a bias current supply circuit for supplying a bias current to the current mirror circuit, a switching element for turning ON and OFF the bias current supply circuit, and an output transistor for generating a reference voltage, an integration (delay) circuit formed by a resistor and a capacitor is connected to the current mirror circuit switching circuit, to smooth changes in a control voltage. Thus, spurious waveform in the reference voltage can be suppressed. This will be explained later in detail.

In the prior art reference voltage generating circuit, however, the resistance value of the resistor and/or the capacitance value of the capacitor has to be increased to increase the time constant of the delay circuit. As a result, it is difficult to incorporate the prior art reference voltage generating circuit including the delay circuit into one integrated circuit.

SUMMARY OF THE INVENTION

It is an object of the present invention to suppress spurious waveforms in the output of a reference voltage generating circuit which can be introduced into one integrated circuit.

According to the present invention, in a reference voltage generating circuit including a current mirror circuit having an input and an output, a bias current supply circuit for supplying a bias current to the input of the current mirror circuit, a switching element for turning ON and OFF the bias current supply circuit, and an output transistor for generating a reference voltage, a delay circuit formed by a capacitor is connected to the output of the current mirror circuit.

Since the capacitance of the capacitor is small, the reference voltage generating circuit including this capacitor can be introduced into one integrated circuit.

BRIEF DESCRIPTION OF THE DRAWINGS

The present invention will be more clearly understood from the description as set forth below, with reference to the accompanying drawings, wherein.

DESCRIPTION OF THE PREFERRED EMBODIMENT

Before the description of the preferred embodiment, prior art reference voltage generating circuits will be explained with reference to FIGS. 1, 2, 3 and 4.

Figure 1:
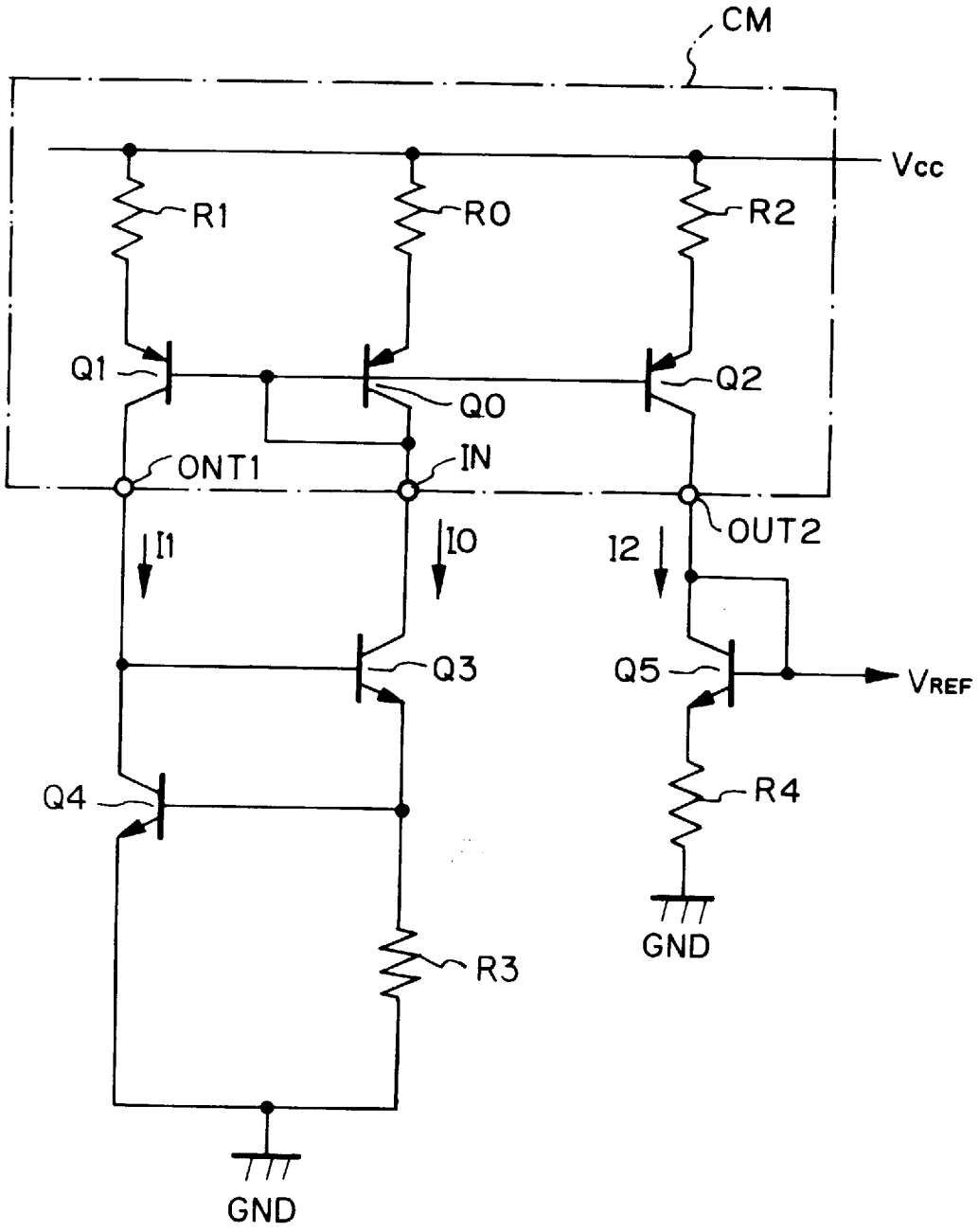
Fig. 1 PRIOR ART
FIG. 1 is a circuit diagram illustrating a first prior art reference voltage generating circuit.

In FIG. 1, which illustrates a first prior art reference voltage generating circuit, reference CM designates a current mirror circuit having an input IN and two outputs OUT1 and OUT2. In more detail, a resistor R0 and PNP-type transistor Q0 are connected in series between a power supply terminal $V_{CC}$ and the input IN of the current mirror circuit CM, a resistor R1 and a PNP-type transistor Q1 are connected in series between the power supply terminal $V_{CC}$ and the output OUT1 of the current mirror circuit CM, and a resistor R2 and a PNP-type transistor Q2 are connected in series between the power supply terminal $V_{CC}$ and the output OUT2 of the current mirror circuit CM. The bases of the transistors Q0, Q1 and Q2 are connected to the input IN of the current mirror circuit CM.

Also, an NPN-type transistor Q3 and a resistor R3 are connected in series between the input IN of the current mirror circuit CM and a ground terminal GND. In this case, the base of the transistor Q3 is connected to the output OUT1. Further, an NPN-type transistor Q4 is connected between the output terminal OUT 1 of the current mirror circuit CM and the ground terminal GND. In this case, the base of the transistor Q4 is connected to a node between the emitter of the transistor Q3 and Q4 and the resistor R3 form a bias current supply circuit for supplying a bias current I0 to the current mirror circuit CM. Note that the bias current I0 is defined by $$I0=V_{BE4}/R3$$

where $V_{BE4}$ is a base-emitter voltage of the transistor Q4, and R3 is a resistance value of the resistor R3.

In addition, a diode-connected NPN-type transistor Q5 and a resistor R4 are connected in series between the output OUT2 of the current mirror circuit CM and the ground terminal GND. The base (collector) of the transistor Q5 generates a reference voltage $V_{REF}$.

In FIG. 1, if the bias current I0 flows through the transistor Q0, a current I1 flows through the transistor Q1 and a current I2 flows through the transistor Q2. In this case, as stated above, the bias current I0 is definite. Also, if the emitter areas of the transistors Q1, Q2 and Q3 are the same as each other,

I0=I1=I2

Therefore, the reference voltage $V_{REF}$ can be definite.

Figure 2:
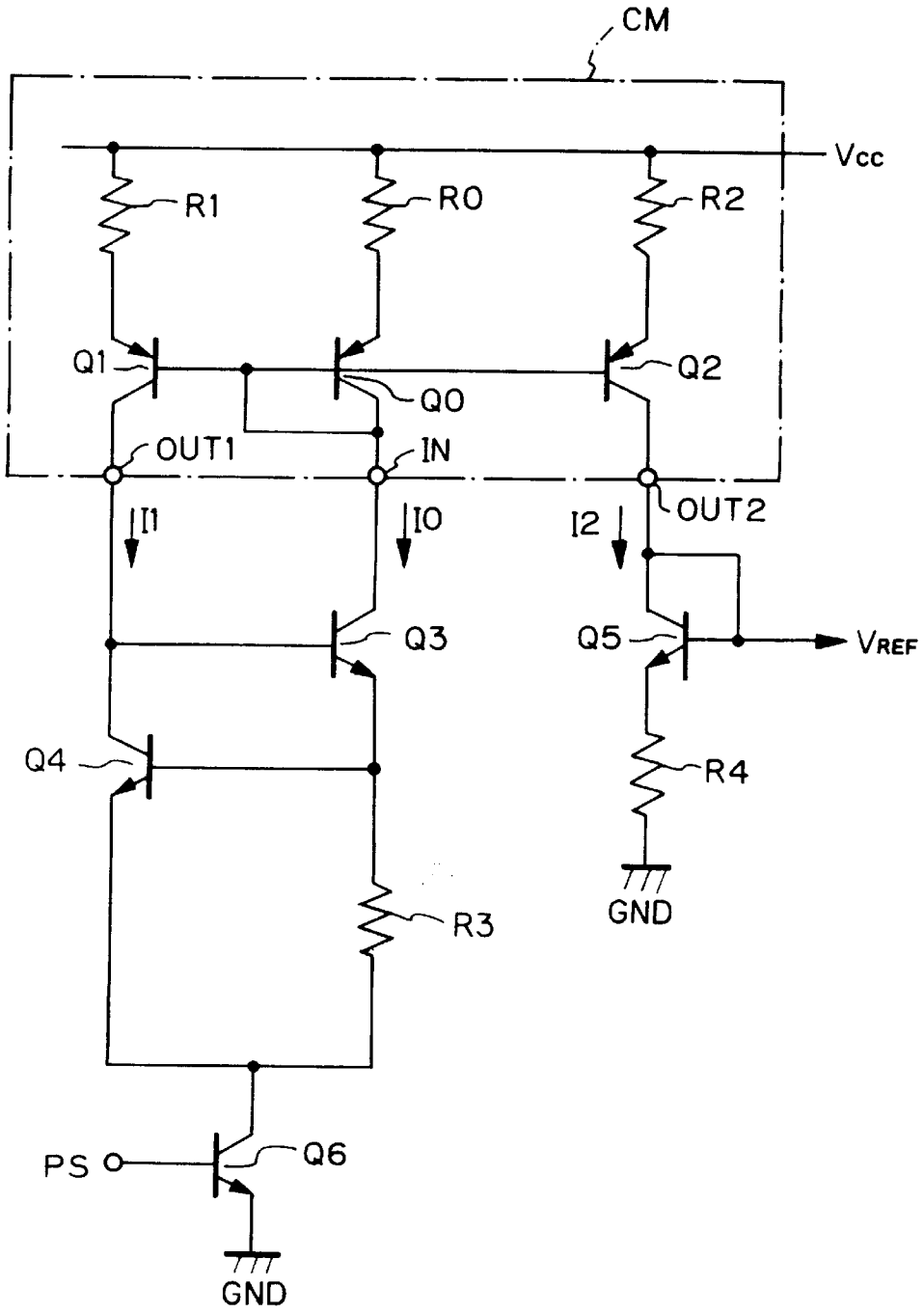
Fig. 2 PRIOR ART
FIG. 2 is a circuit diagram illustrating a second prior art reference voltage generating circuit.

When the reference voltage generating circuit of FIG. 1 is applied to a digital mobile apparatus, a power saving function is provided to reduce the power dissipation during a standby mode as illustrated in FIG. 2, which illustrates a second prior art reference voltage generating circuit. In FIG. 2, an NPN-type transistor Q6 is connected between the resistor R3 (the emitter of the transistor Q4) and the ground terminal GND of FIG. 1. That is, when a voltage at a power saving terminal PS is low (GND), the currents I0 and I1 are cut OFF and the current I2 is suppressed to reduce the power dissipation.

Figure 3:
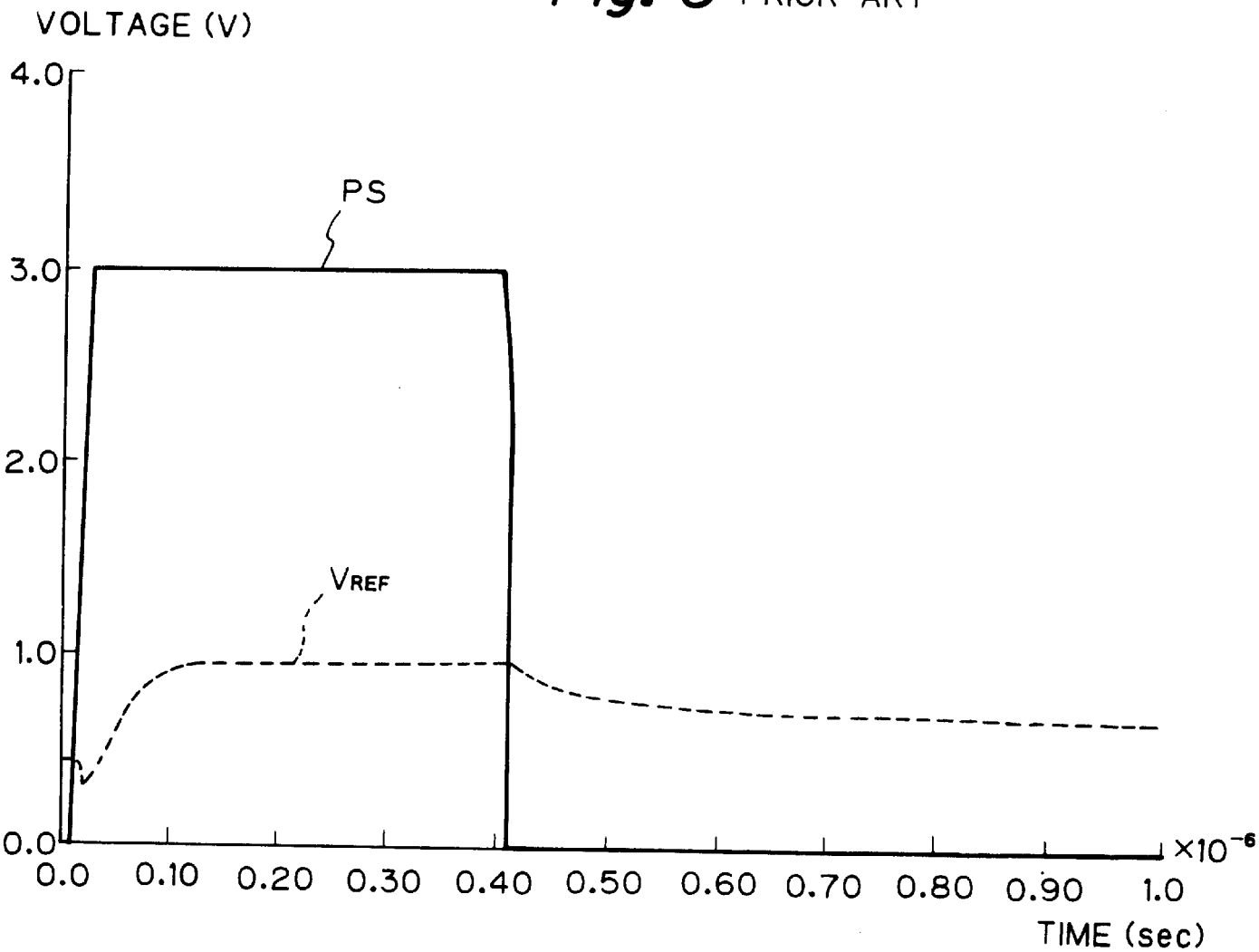
Fig. 3 PRIOR ART
FIG. 3 is a timing diagram for explaining the operation of the circuit of FIG. 2.

In the circuit of FIG. 2, however, as shown in FIG. 3, when the voltage at the power saving terminal PS rises, the reference voltage $V_{REF}$ rapidly rises, which may generate a spurious waveform in the reference voltage $V_{REF}$.

Figure 4:
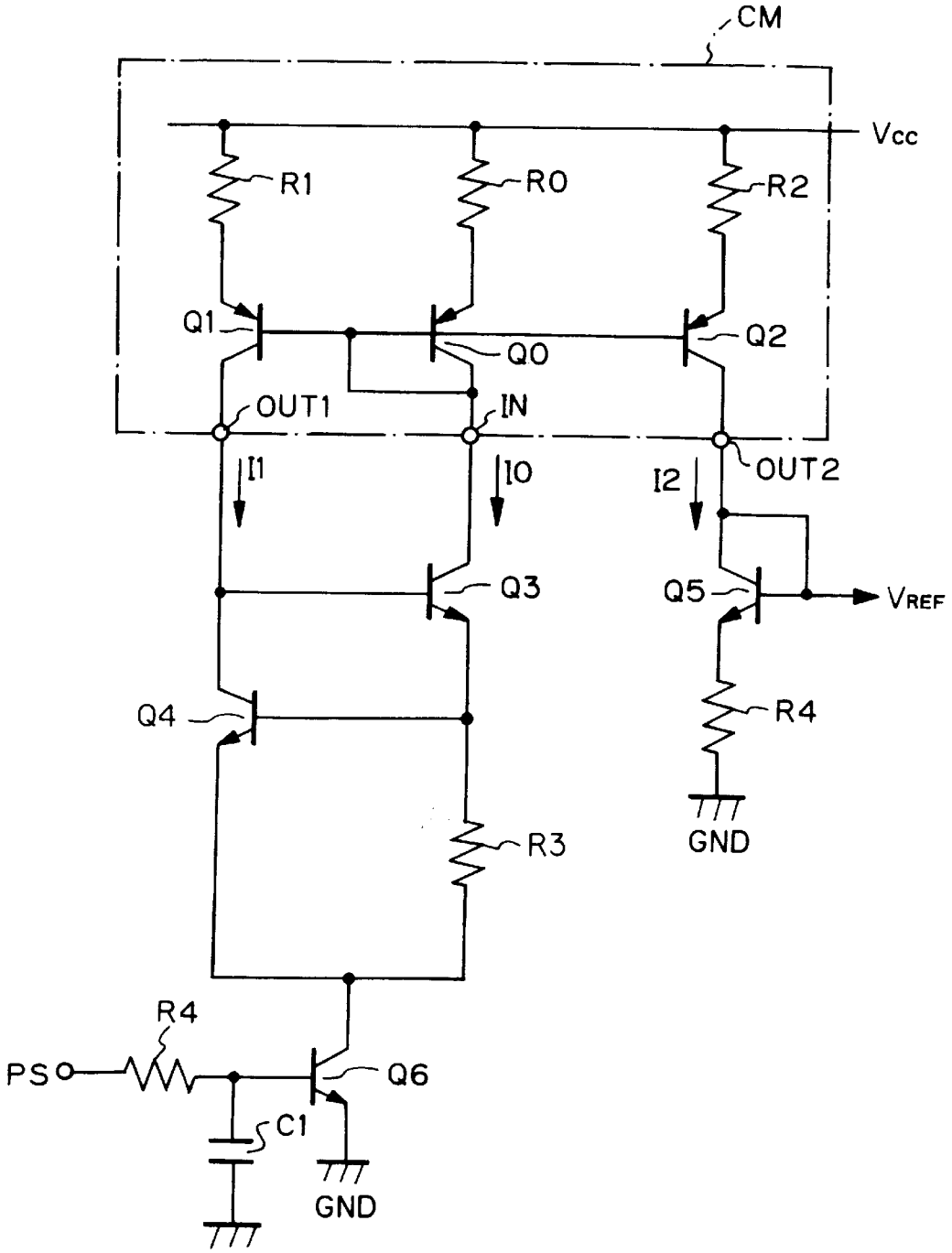
Fig. 4 PRIOR ART
FIG. 4 is a circuit diagram illustrating a third prior art reference voltage generating circuit.

In FIG. 4, which illustrates a third prior art reference voltage generating circuit, an integration (delay) circuit formed by a resistor R4 and a capacitor C1 is interposed between the power saving terminal PS and the base of the transistor Q6 of FIG. 2, to smooth the change of the voltage at the base of the transistor Q6. Thus, the spurious waveform in the reference voltage $V_{REF}$ can be suppressed.

In the circuit of FIG. 4, however, the resistance value of the resistor R4 and/or the capacitance value of the capacitor C1 has to be increased to increase the time constant of the delay circuit (R4, C1). As a result, it is difficult to incorporate the circuit of FIG. 4 including the delay circuit (R4, C1) into one integrated circuit.

Figure 5:
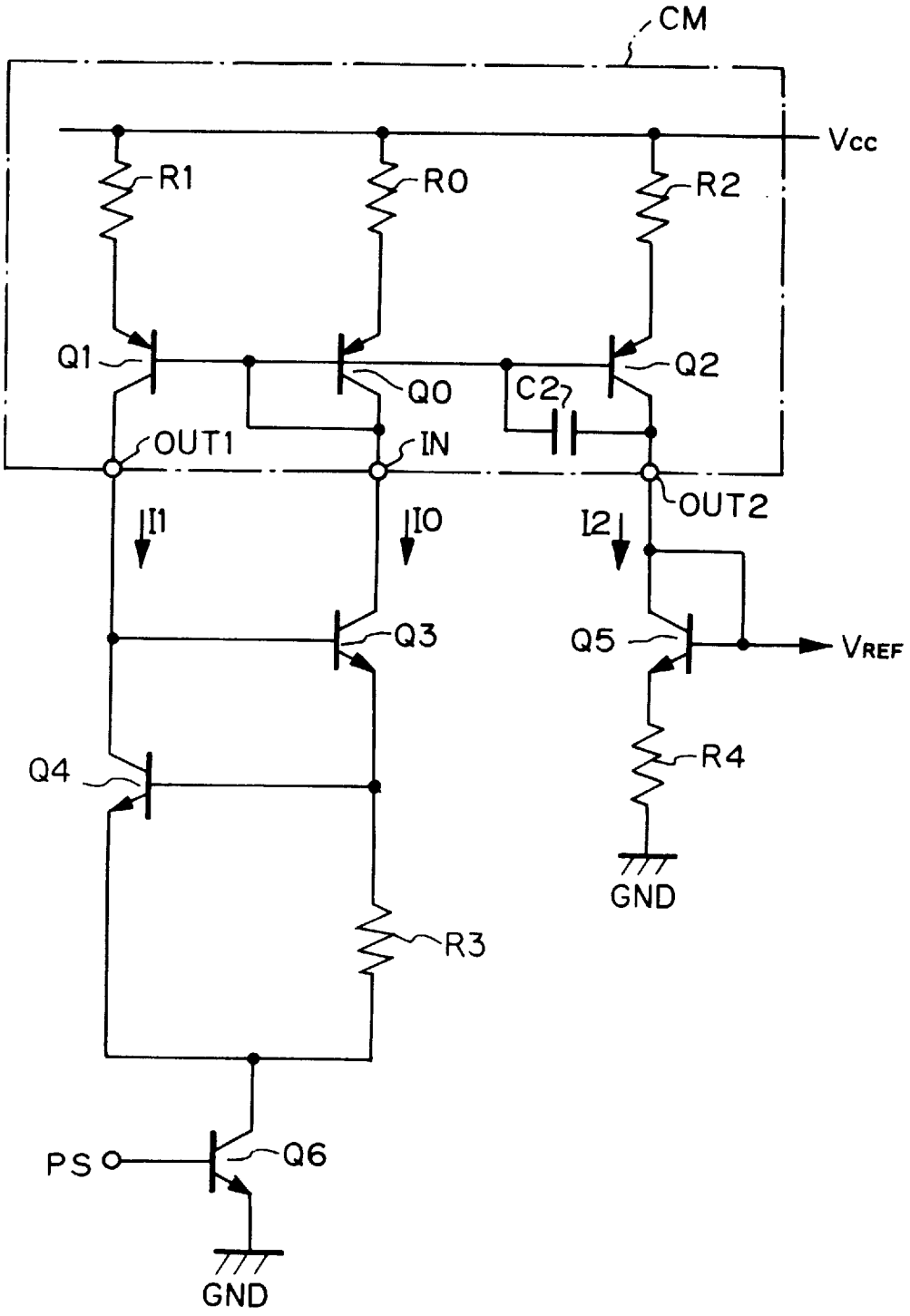
FIG. 5 is a circuit diagram illustrating an embodiment of the reference voltage generating circuit according to the present invention.

In FIG. 5, which illustrates an embodiment of the present invention, a capacitor C2 is interposed between the base and the collector of the transistor Q2 of FIG. 2. The capacitor C2 forms a delay circuit whose delay time t is defined by $$t = C2 \cdot \Delta V / I2$$

Figure 6:
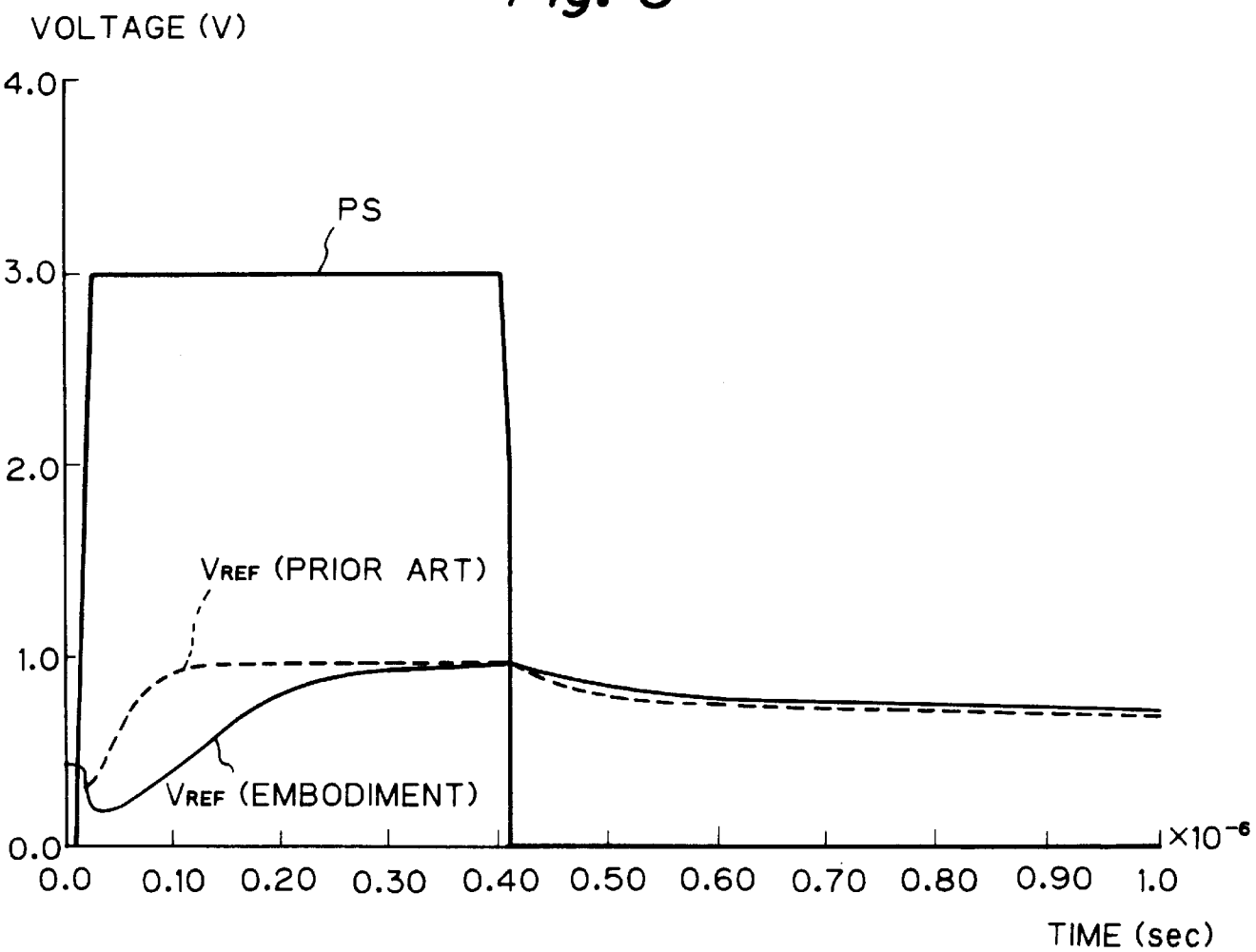
FIG. 6 is a timing diagram for explaining the operation of the circuit of FIG. 5.

For example, if C2 is 5 pF and I2 is 67.6 $\mu$A, the reference voltage $V_{REF}$ slowly rises as shown in FIG. 6. Note that the rising time of the reference voltage $V_{REF}$ is 120 ns in this embodiment, while the rising time of the reference voltage $V_{REF}$ is 300 ns in the prior art circuit of FIG. 2.

Thus, since the capacitance of the capacitor C2 is very small, it is easy to incorporate the circuit of FIG. 5 including the delay circuit (C2) into one integrated circuit.

As explained hereinabove, according to the present invention, since the spurious waveform in the reference voltage is suppressed by a small capacitance capacitor, the reference voltage generating circuit including such a capacitor can be introduced into one integrated circuit.

I claim:

1. A reference voltage generating circuit comprising:

a current mirror circuit having an input and an output;

a bias current supply circuit, connected to the input of said current mirror circuit, for supplying a bias current to the input of said current mirror circuit;

a switching element, connected to said bias current supply circuit, for turning ON and OFF said bias current supply circuit;

an output transistor, connected to the output of said current mirror circuit, for generating a reference voltage; and a delay circuit formed by a capacitor connected to the output of said current mirror circuit.

2. A reference voltage generating circuit comprising:

first and second power supply terminals;

a power saving terminal;

a current mirror circuit connected to said first power supply terminal and having an input and first and second outputs;

a first transistor having a collector connected to said input and a base connected to said first output;

a first resistor connected to an emitter of said first transistor;

a second transistor having a collector connected to said first output and a base connected to said first transistor;

a third transistor having a collector connected to an emitter of said second transistor and said first resistor, an emitter connected to said second power supply terminal, and a base connected to said power saving terminal;

a fourth transistor having a collector connected to said second output and a base connected to the collector thereof, for generating a reference voltage;

a second resistor connected between an emitter of said fourth transistor and said second power supply terminal; and a delay circuit formed by a capacitor connected to said second output.

3. The reference voltage generating circuit as set forth in claim 2, wherein said current mirror circuit comprises:

a fifth transistor having an emitter connected to said first power supply terminal, a collector connected to said input and a base connected to said input;

a sixth transistor having an emitter connected to said first power supply terminal, a collector connected to said first output and a base connected to said input; and a seventh transistor having an emitter connected to said first power supply terminal, a collector connected to said second output and a base connected to said input, said capacitor being connected between the collector and the base of said seventh transistor.

4. The reference voltage generating circuit as set forth in claim 3, wherein said current mirror circuit further comprises:

a third resistor connected between said first power supply terminal and the emitter of said fifth transistor;

a fourth resistor connected between said first power supply terminal and the emitter of said sixth transistor; and a fifth resistor connected between said first power supply terminal and the emitter of said seventh transistor.

5. A reference voltage generating circuit comprising:

a power supply terminal;

a ground terminal;

a power saving terminal;

first, second and third resistors connected to said power supply terminal;

a first PNP-type transistor having an emitter connected to said first resistor, a collector and a base connected to the collector;

a second PNP-type transistor having an emitter connected to said second resistor, a collector, and a base connected to the collector of said first PNP-type transistor;

a third PNP-type transistor having an emitter connected to said third resistor, a collector, and a base connected to the collector of said first PNP-type transistor;

a capacitor connected between the collector and the base of said third PNP-type transistor;

a first NPN-type transistor having a collector connected to the collector of said first PNP-type transistor, an emitter, and a base connected to the collector of said second PNP-type transistor;

a fourth resistor connected to the emitter of said first NPN-type transistor;

a second NPN-type transistor having a collector connected to the collector of said second PNP-type transistor, en emitter, and a base connected to the emitter of said first PNP-type transistor;

a third NPN-type transistor having a collector connected to the collector of said third PNP-type transistor, an emitter, and a base, connected to the collector of said third PNP-type transistor for generating a reference voltage;

a fifth resistor connected to the emitter of said third NPN-type transistor; and a fourth NPN-type transistor having a collector connected to the emitter of said second NPN-type transistor and said fourth resistor, a base connected to said power saving terminal, and an emitter connected to said ground terminal.

* * * * *